US008991105B2

(12) United States Patent
Harvey

(10) Patent No.: US 8,991,105 B2
(45) Date of Patent: Mar. 31, 2015

(54) COLLAPSIBLE BUILDING HAVING RIGID WALLS

(76) Inventor: Donald L. Harvey, Lakeland, MI (US)

( * ) Notice: Subject to any disclaimer, the term of this patent is extended or adjusted under 35 U.S.C. 154(b) by 1519 days.

(21) Appl. No.: 11/372,537

(22) Filed: Mar. 10, 2006

(65) Prior Publication Data

US 2007/0209294 A1 Sep. 13, 2007

(51) Int. Cl.
*E04B 1/346* (2006.01)
*E04B 1/344* (2006.01)
*E04B 1/343* (2006.01)

(52) U.S. Cl.
CPC ..... *E04B 1/3445* (2013.01); *E04B 1/3448* (2013.01); *E04B 1/34336* (2013.01)
USPC ..... 52/66; 52/68; 52/69

(58) Field of Classification Search
CPC .. E04B 1/3445; E04B 1/3448; E04B 1/34336
USPC ..... 52/66, 68, 69, 745.2; 248/188.8, 188.9; 296/165
See application file for complete search history.

(56) References Cited

U.S. PATENT DOCUMENTS 3,095,616 A * 7/1963 Bigelow, Jr. ..... 52/143
3,360,294 A * 12/1967 Leo Cieslak ..... 296/165
3,694,022 A * 9/1972 Dontigny ..... 296/170
3,709,551 A * 1/1973 McCarthy ..... 296/170
3,751,863 A * 8/1973 Lyons ..... 52/111
3,768,855 A * 10/1973 Laue ..... 296/26.02
3,850,470 A * 11/1974 Trelle ..... 296/175
3,941,414 A * 3/1976 Platt ..... 296/170
4,027,912 A * 6/1977 Pacca ..... 296/160
4,354,331 A * 10/1982 Dyke ..... 52/66
4,425,741 A * 1/1984 Ronai ..... 52/70
4,448,453 A * 5/1984 Irelan et al. ..... 296/156
4,577,772 A * 3/1986 Bigliardi ..... 220/1.5
4,603,658 A * 8/1986 Garnsey ..... 119/499
4,638,604 A * 1/1987 Rogers et al. ..... 52/6
4,768,824 A * 9/1988 Andonian ..... 296/165
4,829,726 A * 5/1989 de Potter d'Indoye ..... 52/66
4,939,874 A * 7/1990 Compton ..... 52/4
5,107,639 A * 4/1992 Morin et al. ..... 52/71
5,366,266 A * 11/1994 Harbison ..... 296/100.02
5,461,832 A * 10/1995 Smith ..... 52/69
5,761,854 A * 6/1998 Johnson et al. ..... 52/69
6,086,134 A * 7/2000 Cravens et al. ..... 296/100.06
6,253,498 B1 * 7/2001 Fanucci ..... 52/69
6,299,124 B1 * 10/2001 Reback et al. ..... 248/519
6,766,623 B1 * 7/2004 Kalnay ..... 52/641
7,152,614 B2 * 12/2006 Kalnay ..... 135/128
2003/0140573 A1 * 7/2003 Marcinkowski et al. ..... 52/79.5
2007/0202796 A1 * 8/2007 Kennedy et al. ..... 454/230

* cited by examiner

*Primary Examiner* — Brian Glessner
*Assistant Examiner* — Joshua Ihezie
(74) *Attorney, Agent, or Firm* — Howard & Howard Attorneys PLLC

(57) ABSTRACT

A structure includes a base, a first side wall rotatably attached to the base, a second side wall rotatably attached to the base, a roof guidingly coupled to both the first side wall and the second side wall, and a biasing assembly selectively urging the building into a fully erected configuration.

23 Claims, 10 Drawing Sheets

COLLAPSIBLE BUILDING HAVING RIGID WALLS

TECHNICAL FIELD

The present invention generally relates to buildings that are readily collapsible, erected and transportable.

BACKGROUND

Temporary housing structures, such as moveable buildings, are typically used when more permanent buildings are impractical. Moveable buildings provide the flexibility of positioning a housing structure in a desired location within a relatively short period of time. However, many moveable buildings are non-collapsible and bulky to transport. Further, some moveable buildings are collapsible to an extent, but not sufficiently collapsible to allow for multiple buildings to be transported. Accordingly, there exists a need for readily collapsible buildings that form a structure when erected.

BRIEF DESCRIPTION OF THE DRAWINGS

Referring now to the drawings, preferred illustrative embodiments are shown in detail. Although the drawings represent some embodiments, the drawings are not necessarily to scale and certain features may be exaggerated, removed, or partially sectioned to better illustrate and explain the present invention. Further, the embodiments set forth herein are not intended to be exhaustive or otherwise limit or restrict the claims to the precise forms and configurations shown in the drawings and disclosed in the following detailed description.

DETAILED DESCRIPTION

Figure 1:
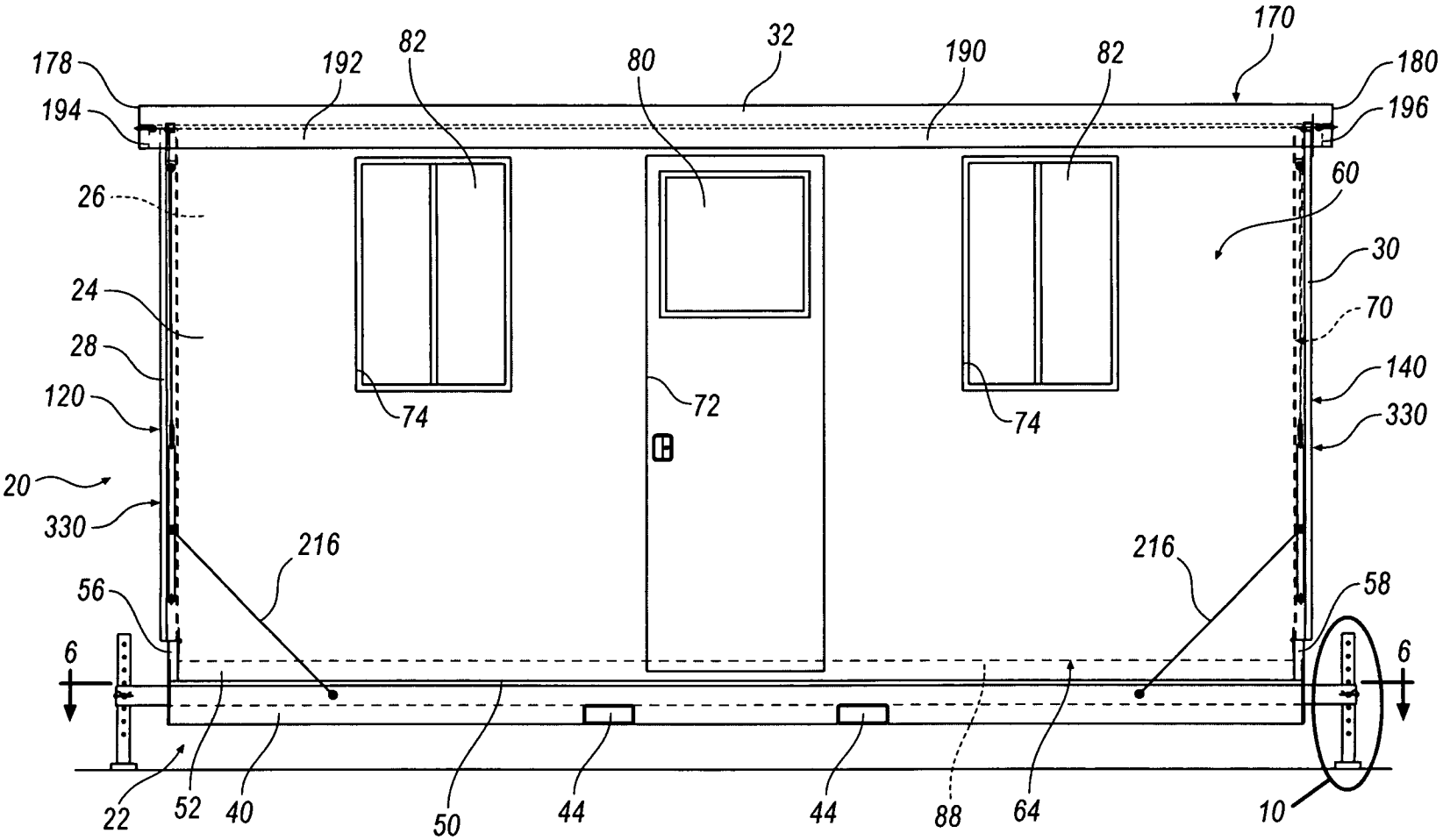
FIG. 1 is a side view of a building according to an embodiment.

As best seen in at least one of FIGS. 1-5, a building 20 is illustrated. Building or structure 20 includes a foundation 22, a generally planar front wall 24, a generally planar back wall 26, a generally planar first side wall 28, a generally planar second side wall 30, and a roof 32. Walls 24, 26, 28, 30 each have a collapsed position or configuration in which it is substantially horizontal, and an erected position or configuration in which it is substantially vertical, as clearly shown in FIGS. 3-5. As best seen in at least one FIGS. 1, 2, and 6, foundation 22 includes a plurality of standoff assemblies 38 interconnected by a base, or frame, 40 that includes rails 42 that extend beyond the front wall 24 and the back wall 26. Frame 40 also includes tubes 44, cross members 46 and end members 48. As illustrated, the rails 42 and cross members 46 interconnect the tubes 44 and end members 48 to provide a base for the building 20. A floor panel 50 (FIG. 1) is positioned above the frame 40. Frame 40 further includes a front wall extension 52, a back wall extension 54, a first side extension 56, and as second side extension 58 extending upward therefrom.

The front wall 24 includes an inner frame (not numbered) that supports opposing panels (not numbered). The front wall 24 is generally defined by an outer front surface 60, an inner front surface 62, a lower front end 64, an upper front end 66, a first front side 68, a second front side 70, a door opening 72, and a plurality of window openings 74. Door opening 72 has a door 80 coupled thereto and each window opening 74 has a window 82 coupled thereto. As illustrated, the lower front end 64 is rotatably attached to the front wall extension 52 with a front hinge 88. Thus, front wall 24 is rotatably attached to base or frame 40.

The back wall 26 includes an inner frame (not numbered) that supports opposing panels (not numbered). The back wall 26 is generally defined by an outer back surface 90, an inner back surface 92, a lower back end 94, an upper back end 96, a first back side 98, a second back side 100, and a plurality of openings (not shown). Each opening may have a breaker box, air conditioner, or other operable item attached thereto. The lower back end 94 is rotatably attached to the back wall extension 54 with a back hinge 108. Thus, back wall 26 is rotatably attached to base or frame 40.

Similarly, the first side wall 28 includes an inner frame (not numbered) that supports opposing panels (not numbered). The first side wall 28 is generally defined by a generally planar outer surface 120, a generally planar inner surface 122, a lower end 124, an upper end 126, a front side 128, and a back side 130. The lower end 124 is rotatably attached to a first side extension 56 with a side hinge 138. Thus, first side wall 28 is rotatably attached to base or frame 40.

Additionally, the second side wall 30 includes an inner frame (not numbered) that supports opposing panels (not numbered). The second side wall 30 is generally defined by a generally planar outer surface 140, a generally planar inner surface 142, a lower end 144, an upper end 146, a front side 148, and a back side 150. The lower end 144 is rotatably attached to a second side extension 58 with a side hinge 158. Thus, second side wall 30 is rotatably attached to base or frame 40. From the foregoing, and with reference to FIGS. 3-5, it can be clearly understood that each of walls 24, 26, 28, 30 has angular movement relative to base or frame 40 between its respective collapsed and erected position or configuration; and that each of walls 24, 26, 28, 30 superposes base or frame 40 and roof 32 in its respective collapsed position or configuration, and extends between base or frame 40 and roof 32 in its respective erected position or configuration. The superposition of each of collapsed walls 24, 26, 28, 30 relative to base 40 or roof 32, is understood to mean its respectively overlying or underlying the base or the roof, directly or indirectly, as shown, for example, in FIGS. 2-5.

The roof 32 includes a generally planar roof outer surface 170, an opposing generally planar roof inside surface 172, a front edge 174, a back edge 176, a first side edge 178, and a second side edge 180. In the embodiment illustrated, the front edge 174 and the back edge 176 have an overhang 190 with a track 192 attached thereto. Each track 192 has a first end 194 and a second end 196 (FIGS. 1 and 5).

Figure 2:
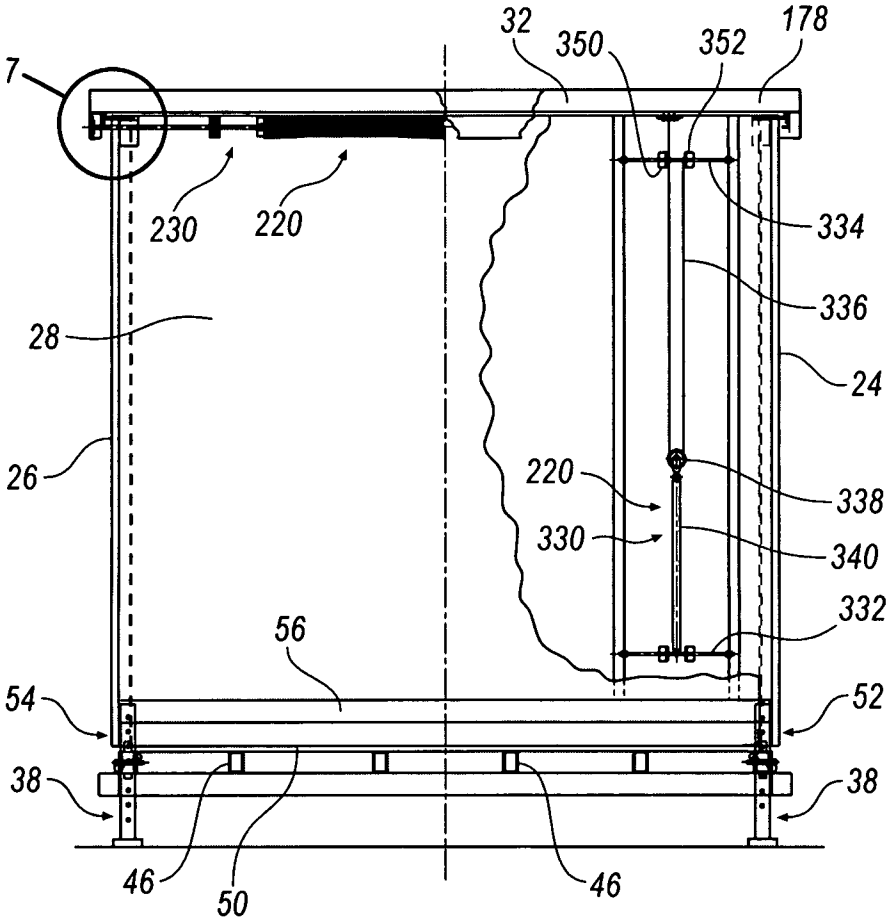
FIG. 2 is an end view of the building of FIG. 1, illustrating multiple embodiments.
Figure 7:
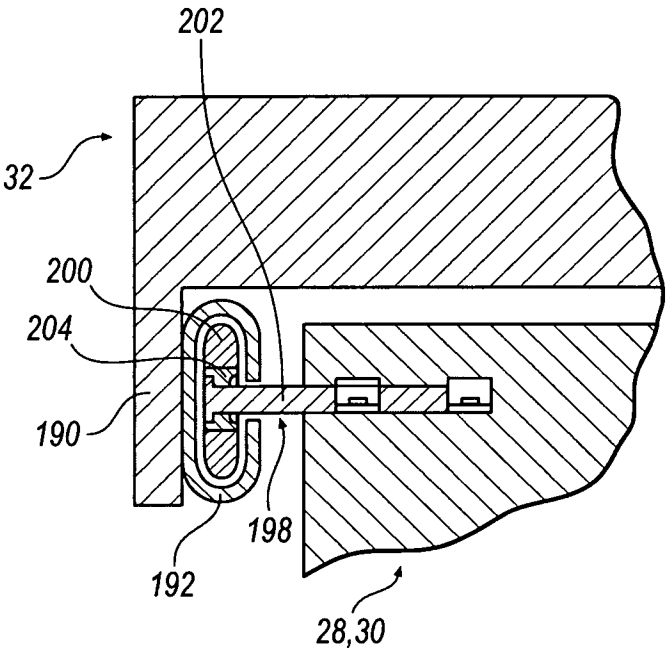
FIG. 7 is an enlarged view of portion 7 of FIG. 2.

As best seen in FIG. 2 with greater detail in FIG. 7, the first side wall 28 and the second side wall 30 each include a pair of guide rollers 198 extending therefrom. Guide rollers 198 each include a wheel 200, a stem 202, and a bearing 204 rotatably connecting the wheel 200 and the stem 202. Stems 202 are attached to the first side wall 28 and the second side wall 30 with wheels 200 interposed within tracks 192, generally as illustrated. Preferably, the axes of stems 202 and wheels 200 are generally parallel with the tubes 44, and generally perpendicular to the extension, of the track 192 from the first end 194 to the second end 196. Other embodiments include a guide roller without a bearing 204, where the wheel 200 is made of nylon or other low-friction materials. From the foregoing, and with reference to FIGS. 5 and 7, those of ordinary skill in the art will clearly recognize that the first and second side walls 28, 30 are guidingly coupled to roof 32 through the operative engagement of the side wall guide rollers and the roof tracks, and in response to angular movement of the side walls 28, 30 between their collapsed and erected positions or configurations, the roof 32 is moved between its lowered and raised positions, respectively. In other words, the roof is guidingly coupled to both the first and second side walls, and has movement relative to the base guided by angular movement of the first and second side walls between their collapsed and erected configurations, as one of ordinary skill in the art will appreciate from an inspection of the drawings.

Figure 3:
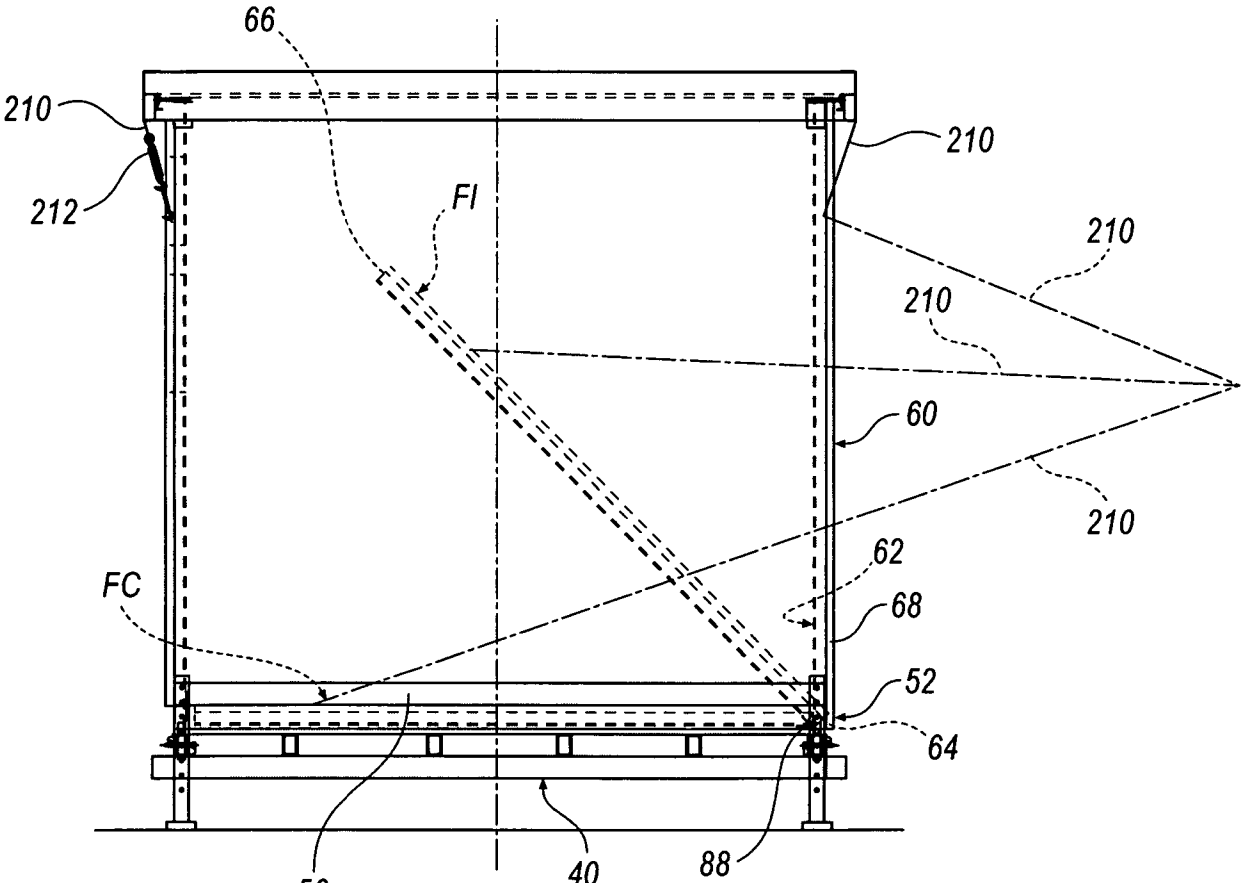
FIG. 3 is a view similar to FIG. 2, illustrating a portion of the building in multiple configurations for clarity.

As best seen in FIG. 3, and embodiment of building 20 includes cables 210 that are connected to the front wall 24, routed over the roof 32, and connected to the back wall 26 via a pair of linearly adjustable turnbuckles 212. Turnbuckles 212 assists in collapsing, erecting, and stabilizing the building 20, such as discussed herein. Squaring cables 216 (FIG. 1) may interconnect the side walls 28, 30 with the frame 40 to further stabilize the building 20 when fully erected. Preferably, fastening assemblies (not shown) rigidly interconnect the front wall 24, back wall 26, first side wall 28, second side wall 30, and roof 32.

Figure 5:
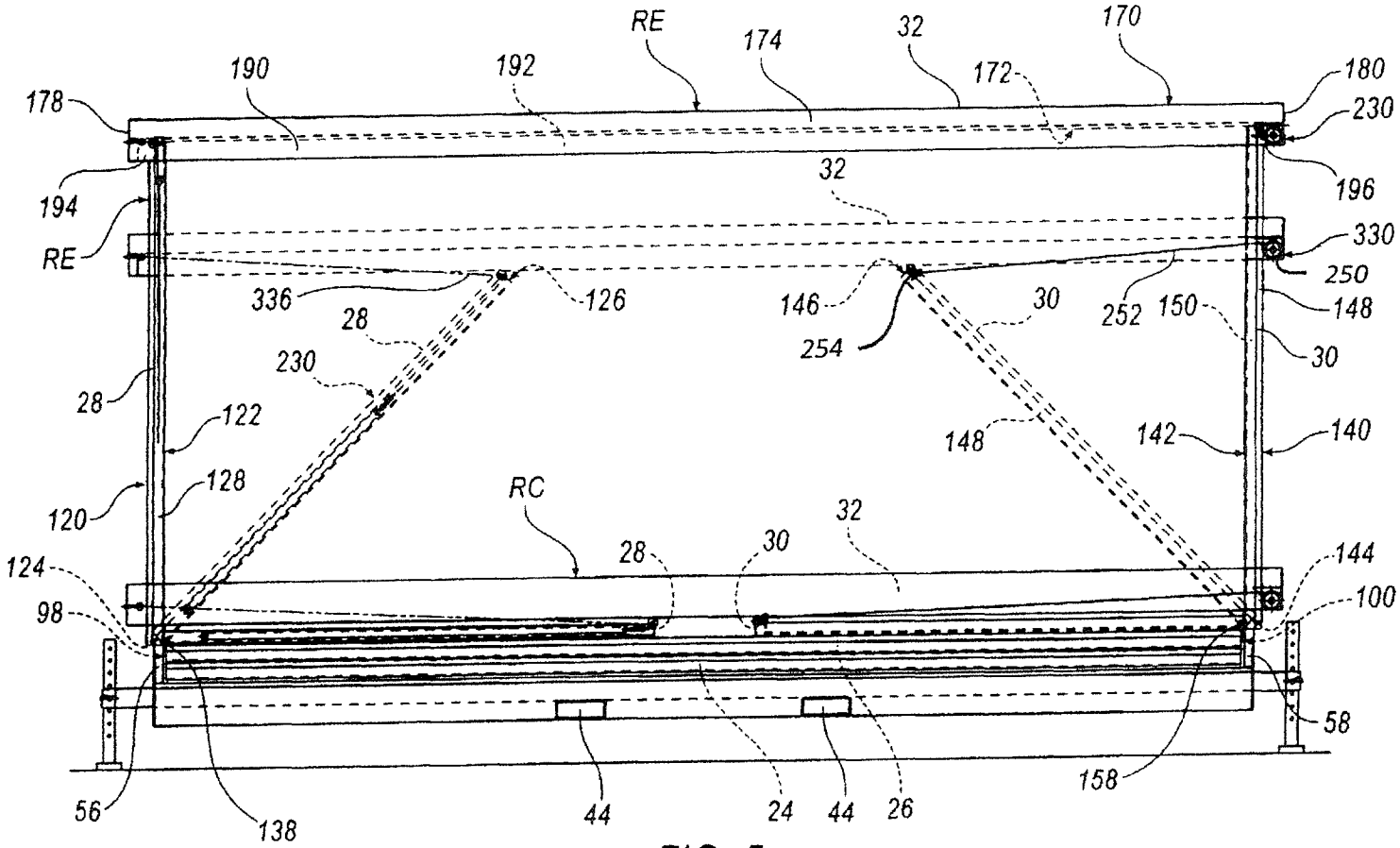
FIG. 5 is a view similar to FIG. 1, illustrating some portions in other configurations and other portions of the building in multiple configurations for clarity.
Figure 6:
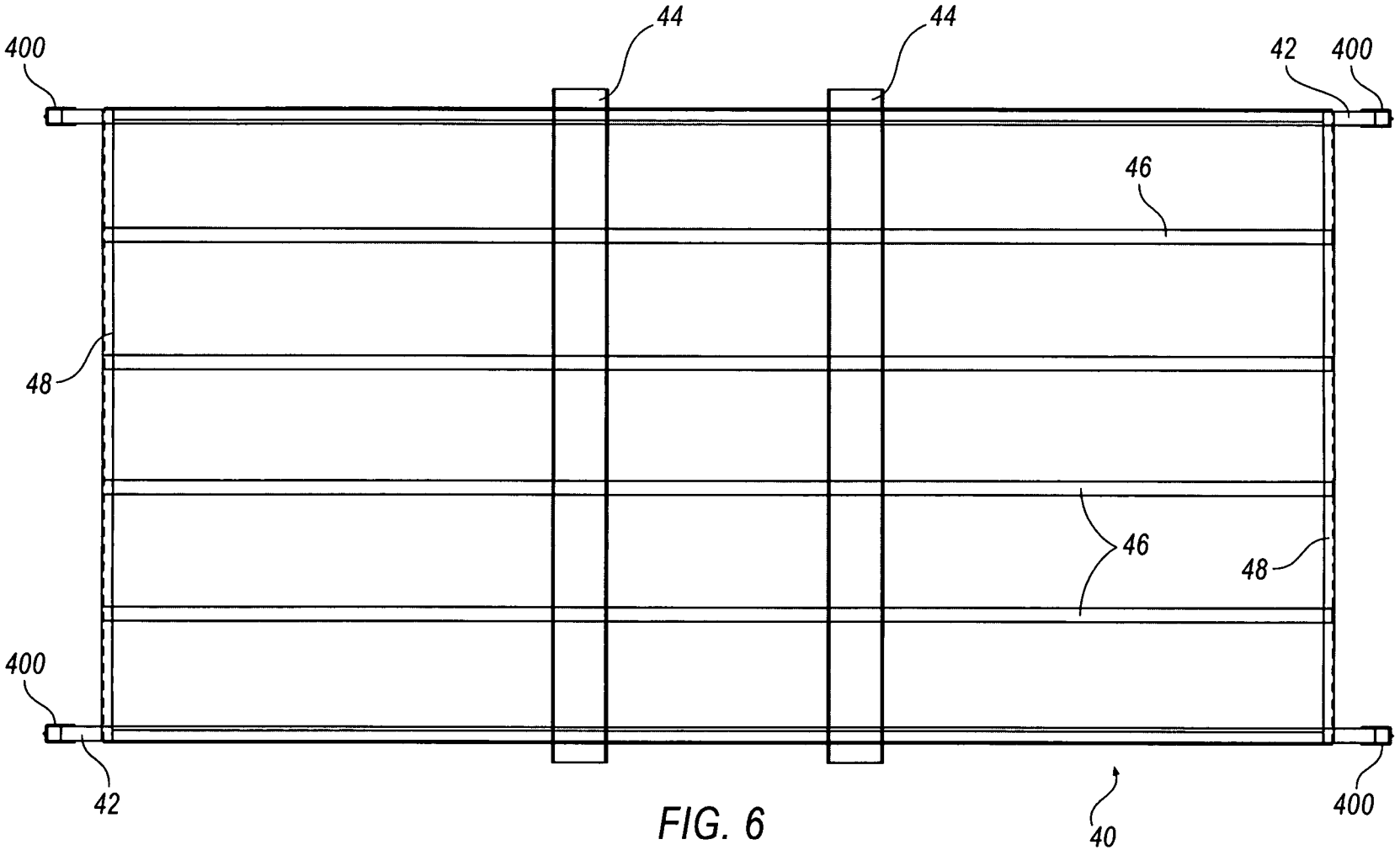
FIG. 6 is a top view of the frame according to an embodiment, taken along line 6-6 of FIG. 1.

As best illustrated in FIGS. 2, 5, the building 20 also includes a pair of biasing assemblies 220 to urge the roof 32, the first side wall 28, and the second side wall 30 into an erected configuration, as discussed in greater detail below. Building 20 is illustrated in a fully erected configuration in FIG. 1 and a fully collapsed configuration in FIG. 12. FIG. 5 illustrates building 20 in an intermediate configuration, the fully erected configuration, and the fully collapsed configuration. As discussed in greater detail below, FIGS. 2 and 5 each illustrate a vertically bisected half of two embodiments of the biasing assembly 220 juxtaposed in relation to the first side wall 28 and the roof 32, with the illustrations of each of FIGS. 2 and 5 discussed herein as though each embodiment is a complete biasing assembly 220, with a vertically bisected half adjacent an identical, minor image vertically bisected half of each embodiment.

Figure 4:
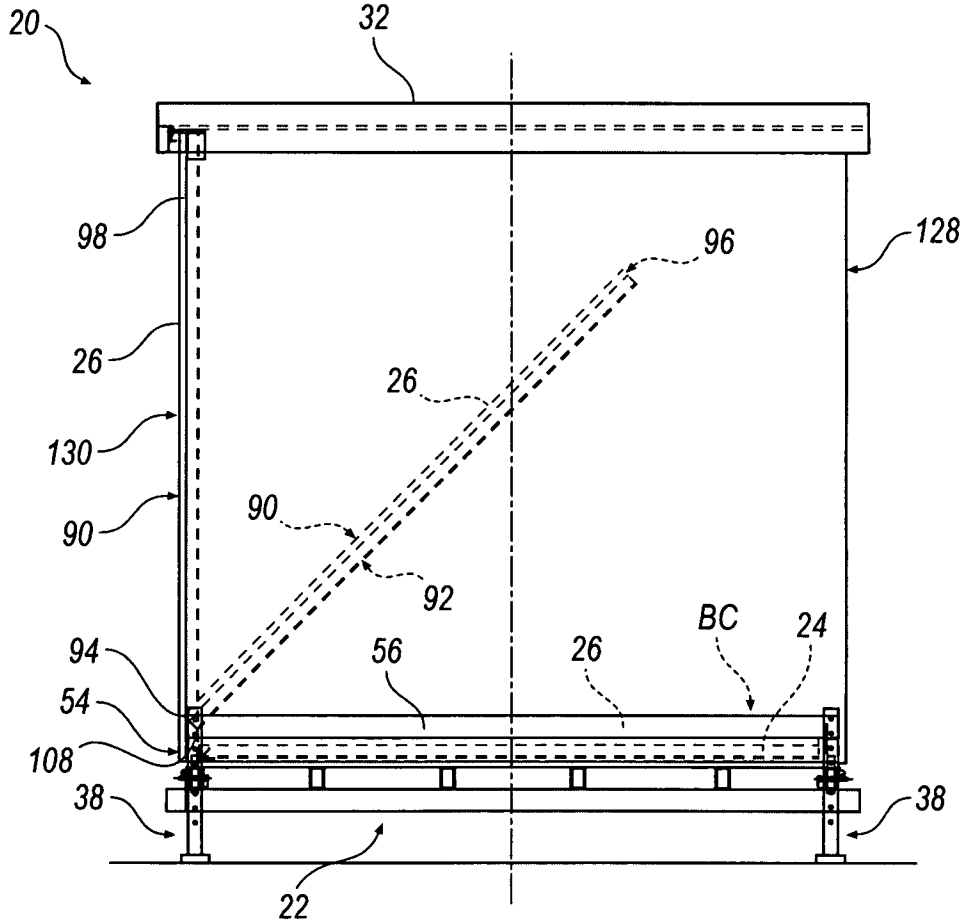
FIG. 4 is a view similar to FIG. 2, illustrating a portion of the building in multiple configurations for clarity.

Briefly, an embodiment of collapsing the building 20 is as follows. Building 20, as best seen in FIGS. 1, 2, and 3, is in the fully erected configuration. Turnbuckles 212 and other fastening assemblies (not shown) that restrain the front wall 24 are detached, and the front wall 24 is rotated relative the frame 40 and front wall extension 52. In one embodiment, the inner surface 62 contacts the floor panel 50. The center of rotation is generally along the axis of front hinge 88. Cables 210 may be used to lower the front wall 24 into a fully collapsed configuration FC illustrated in phantom in FIG. 3. In one embodiment of the fully collapsed configuration of the front wall 24, the inner front surface 62 contacts the floor panel 50. As shown in FIGS. 3 and 4, front wall 24 in its collapsed position or configuration superposes base or frame 40 and roof 32.

Then, the fastening assemblies (not shown) that restrain the back wall 26 are detached, and the back wall 26 is rotated relative the frame 40 and back wall extension 54 into a fully collapsed configuration BC illustrated in phantom in FIG. 4. The center of rotation is generally along the axis of back hinge 108. As illustrated, the front wall extension 52 extends above the frame 40 a distance about equal to the width of the front wall 24, and the back wall extension 54 extends above the frame 40 a distance about equal to the width of the front wall 24 plus the width of the back wall 26. In one embodiment of the fully collapsed configuration of the back wall 26, the inner back surface 92 contacts the outer front surface 60. As shown in FIGS. 3 and 4, back wall 26 in its collapsed position or configuration superposes base or frame 40 and roof 32.

Then, the fastening assemblies (not shown) that restrain the first side wall 28, second side wall 30, and roof 32 are detached, and the roof 32 is lowered, as illustrated in phantom in FIG. 5. As roof 32 is lowered, the first side wall 28 is rotated relative the frame 40 and first side extension 56, and the second side wall 30 is rotated relative the frame 40 and second side extension 58 into a fully collapsed configuration RC illustrated in phantom in FIG. 5. The center of rotation for the first side wall 28 is generally along the axis of side hinge 138. The center of rotation for the second side wall 30 is generally along the axis of side hinge 158. As shown in FIG. 5, the front and back walls 24, 26 are disposed between base 40 and the collapsed side walls 28, 30 which are guidingly coupled to roof 32 through guide rollers 198 and tracks 192. Thus, the front and back walls 24, 26 are moveable between their respective collapsed and erected positions or configurations only when side walls 28, 30 are both in their erected position or configuration and roof 32 is consequently in its raised position, as one of ordinary skill in the art will immediately appreciate. Moreover, those of ordinary skill in the art will clearly recognize that the guide rollers 198 of one of first and second side walls 28, 30 may move along tracks 192 independently of the guide rollers 198 of the other side wall 28, 30, and understand that the angular movements of the first and second side walls 28, 30 relative to the base or frame 40 are therefore independent of each other. In other words, one side wall 28, 30 may be moved angularly relative to frame or base 40 between its collapsed and erected positions or configurations while the other side wall 28, 30 remains erected or collapsed or at positions therebetween. Roof 32 would then, of course, assume angular orientations other than being horizontal or parallel with base or frame 40 as shown in FIG. 5, during its raising and lowering, as one of ordinary skill in the art will immediately understand. Thus, the roof 32 is guidingly coupled to both the first and second side walls 28, 30, and its movement relative to base 40 is guided by the angular movement of the side walls 28, 30 between their collapsed and erected positions or configurations.

Figure 12:
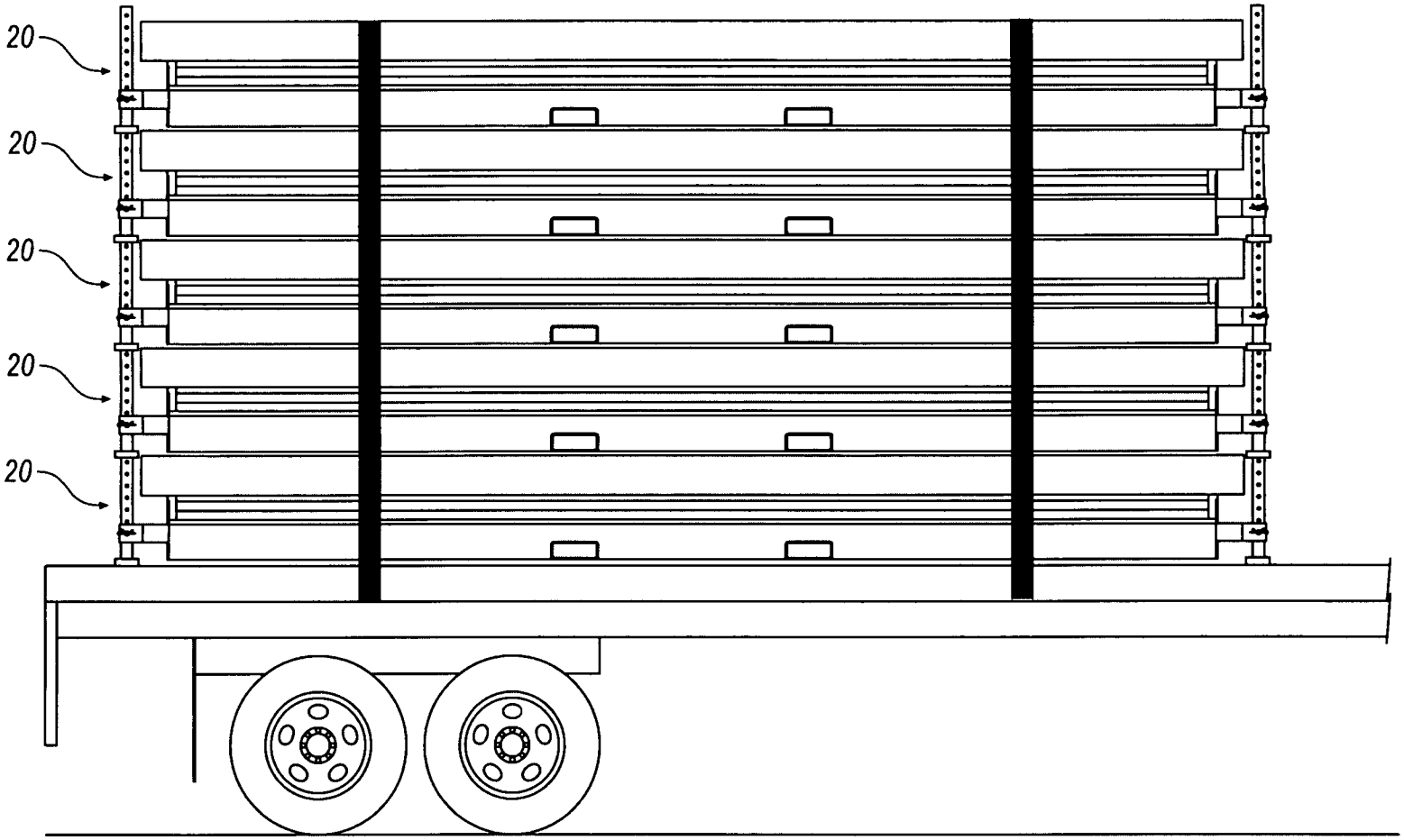
FIG. 12 is a side view illustrating multiple buildings according to an embodiment.

As roof 32 is lowered, the guide rollers 198 are guided within tracks 192 and building 20 may collapse generally as shown in the phantom illustrations of FIG. 5, which depicts by example the case of substantially simultaneous collapsing movement of sidewalls 28 and 30. Additionally, as the roof 32 is lowered, and the first side wall 28, second side wall 30 rotate, the biasing assemblies 220 urgingly resist at least a portion of the weight of first side wall 28, second side wall 30, and roof 32. Thus provided, the biasing assemblies 220 assist an operator or operators in collapsing the building 20, as the entire weight of the portions of the building 20 being collapsed need not be physically resisted. As best seen in FIGS. 5 and 12, the building 20 may be readily collapsed to a fully collapsed configuration where the foot print of the building 20 has not changed, and the height has been reduced to about a minimum.

When fully collapsed, the building 20 may be transported with a conventional forklift via tubes 44 and/or stacked for storage or transportation, as illustrated in FIG. 12. When fully collapsed, the internal features of the building 20, such as a breaker box, internal wiring, electrical outlets (not shown), may be protected from the weather by the overhang 190 and roof 32. Additionally, the biasing assemblies 220 are protected by the overhang 190 and roof 32.

An embodiment of converting the building 20 from the fully collapsed configuration of FIG. 12 to the fully erected configuration of FIG. 1 is as follows. The roof 32 is raised, with assistance of the biasing assemblies 220, thereby rotating the first side wall 28 and the second side wall 30 into a fully erected configuration RE, as shown in FIG. 5. The biasing assemblies 220 may restrain the first side wall 28, the second side wall 30, and the roof 32 in the fully erected configuration, or fasteners may be used to secure the first side wall 28 and the second side wall 30 to roof 32. The back wall 26 is then raised until the upper back end 96 is adjacent the roof 32. Cables 210 may then be used to raise the front wall 24 to the fully erected configuration of FIG. 1. The cables 210 may then be routed over the roof 32 and secured to turnbuckles 212. Additional fasteners may then be used to secure the building 20, if desired. Additional items, such as air conditioner may be then attached to the building 20.

Figure 8:
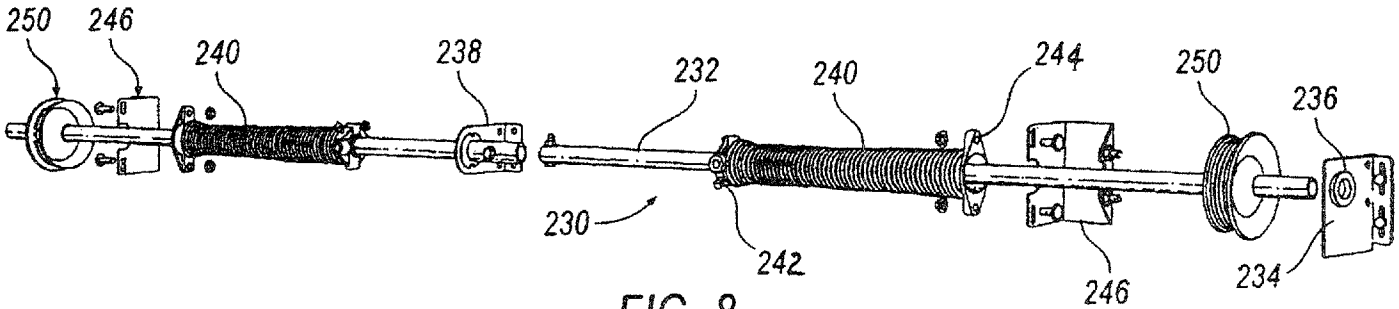
FIG. 8 is an exploded view of an embodiment of a biasing assembly.

As best illustrated in FIGS. 2, 5 and 8, an embodiment of the biasing assembly 220 includes a torsional assembly 230. Torsional assembly 230, as shown generally in FIG. 2 and in detail in FIG. 8, includes a torsion shaft 232 which spans between side bearing brackets 234 which contain bearings 236 that support torsion shaft 232 and allow torsion shaft 232 to rotate freely. While torsion shaft 232, as illustrated, extends the entire width of the first side wall 28 and the second side wall 30, torsion shaft 232 may have one or more sections that are connected in a manner that will allow torque to be transmitted between each section. Torsion shaft 232 may also be supported by intermediate bearing brackets 238 which contain bearings (not numbered) and allow torsion shaft 232 to rotate freely within the bracket bearing. Each torsional assembly 230 is generally located adjacent the first side edge 178 (FIG. 2) or the second side edge 180 (FIG. 5). A pair of torsion springs 240 are positioned on the torsion shaft 232.

Figure 9:
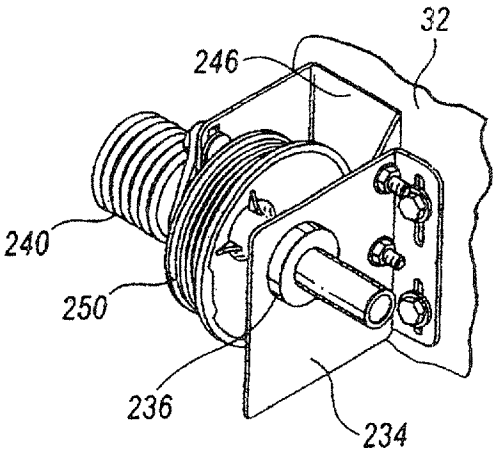
FIG. 9 is a partial view of the assembly of FIG. 8.

A spring winding cone 242 circumscribes torsion shaft 232 and selectively locks against torsion shaft 232 to prevent rotation so that spring winding cone 242 may be rotated to pre-tension spring 240 and may thereafter be locked against rotation so as to maintain the pre-tension force. Spring 240 connects to winding cone 242 at the inner end of spring 240 with a torsionally rigid connection such that when winding cone 242 is rotated, torsion in spring 240 will increase or decrease depending on the direction of rotation. Spring 240 is also torsionally rigidly attached, at its outer end, to an anchor cone 244 which is bolted to an anchor bracket 246 which bends around cable drum 250 (FIG. 9) and attaches to bearing bracket 234. Once installed, the outer ends of springs 240 remain rotationally fixed to anchor brackets 246 and bearing brackets 234. Each of the anchor brackets 246 and bearing brackets 234 may be fastened to the roof 32 with fasteners, such as bolts. A pair of cable drums 250 are torsionally rigidly attached to torsion shaft 232. A cable 252 winds around each cable drum 250 as torsion shaft 232 is rotated, as discussed in greater detail below.

As shown in FIG. 5 distal ends 254 of cables 252 are attached to the upper ends 126, 146 of side walls 28, 30 and the opposing ends of cables 252 are wrapped around the cable drums 250. As the building 20 is collapsed, as discussed in greater detail herein, the cables 252 unwind from the cable drums 250, as distal ends 254 and upper ends 126, 146 move away from the cable drums 250, thereby twisting the springs 240 around the torsion shafts 232 and increasing the torsion in the springs 240 and the energy stored within the springs 240. Thus it may be said that each biasing assembly 220 has first and second states respectively corresponding to the collapsed and erected positions or configurations of the associated side wall 28, 30, in which it has relatively greater and lesser amounts of stored energy. A properly adjusted torsional assembly 230 will exert a generally horizontal force through cables 252 on either the first side wall 28 or the second side wall 30 that is adequate to allow a user to erect the building 20 with the slightest of lifting effort, due to the biasing assembly 220 urging the side walls 28, 30 and roof 32 of structure 20 into their erected or raised positions.

As also illustrated in FIGS. 2 and 5, another embodiment of the biasing assembly 220 includes an axial assembly 330. FIG. 1 illustrates an embodiment with a pair of axial assemblies 330, with one axial assembly 330 positioned at least partially within the first side wall 28, and another axial assembly 330 positioned at least partially within the second side wall 30. Axial assembly 330 includes an anchoring rod 332 and a pulley rod 334 secured within each of the side walls 28, 30. The anchoring rod 332 is positioned just above the side extensions 56, 58, and the pulley rod 334 is positioned just below the upper ends 126, 146 of side walls 28, 30. Cables 336 interconnect the pulley rod 334 and the roof 32. Each cable 336 is routed around a spring pulley 338. A spring 340 extends between the spring pulley 338 and the anchoring rod 332. As best seen in FIG. 5, the pulley rod 334 has a pulley 350 attached thereto, with the cable 336 guided thereon. Each cable 336 has a proximal end 352 attached to the pulley rod 334, then a length extending to the spring pulley 338, then extending at least partially around the spring pulley 338, then a length extending from the spring pulley 338 to the pulley 350, then extending at least partially around the pulley 350, and then a length extending from the pulley 350 to the roof 32, adjacent one of the side edges 178, 180.

As roof 32 is lowered, the guide rollers 198 are guided within tracks 192 away from the side edges 178, 180 of the roof 32 as the pulleys 350 are moved away from the side edges 178, 180. During this movement, the length of cable 336 between the pulley 350 and the roof 32 is increased, thereby decreasing the length between the pulley 350 and the spring pulley 338. As the length between the pulley 350 and the spring pulley 338 is decreased, the spring 340 is expanded, increasing the tension in the spring 340 and the energy stored within the spring 340, and thereby exerting a biasing force on the pulley 350 that urges the upper ends 126, 146 of side walls 28, 30 apart and toward the fully erected position illustrated in FIG. 1. Thus it may be said that each biasing assembly 220 has first and second states respectively corresponding to the collapsed and erected positions or configurations of the associated side wall 28, 30, and in which it has relatively greater and lesser amounts of stored energy, respectively. In this manner, the axial assemblies 330 urge the roof 32 upward and assist a user or users in collapsing the building 20 as the entire weight of the first side wall 28, the second side wall 30 and the roof 32 need not be supported in order to lower the roof 32 to the fully collapsed configuration of FIG. 12. Additionally, the axial assemblies 330 assist a user when erecting the building 20, as the springs 340 biasingly urge the roof 32 away from the frame 40.

Furthermore, the axial assemblies 330 and/or the torsional assemblies 230 can be preloaded with springs 240, 340 distorted when the building 20 is in the fully erected configuration of FIGS. 1 and 2, such that less effort is required to raise the roof 32. To preload a biasing assembly 220, a spring 240, 340 is preloaded to provide a desired amount of force to urge the roof 32 away from the frame 40 at least partially when the building 20 is transformed from the fully collapsed configuration to the fully erected configuration.

Preferably, the hinges 88, 108, 138 and 158 are continuous, 'piano' hinges with an axial hinge rod (not shown) that extends the length of the hinge. Also preferably, any electrical wiring extending from the walls to the floor are routed through flexible conduits that avoid pinch points of the wall to frame connections.

Figure 11:
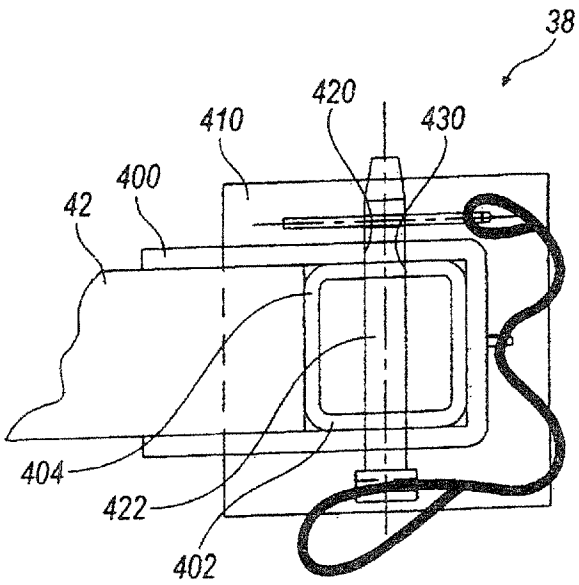
FIG. 11 is a top view of the view of FIG. 10.
Figure 10:
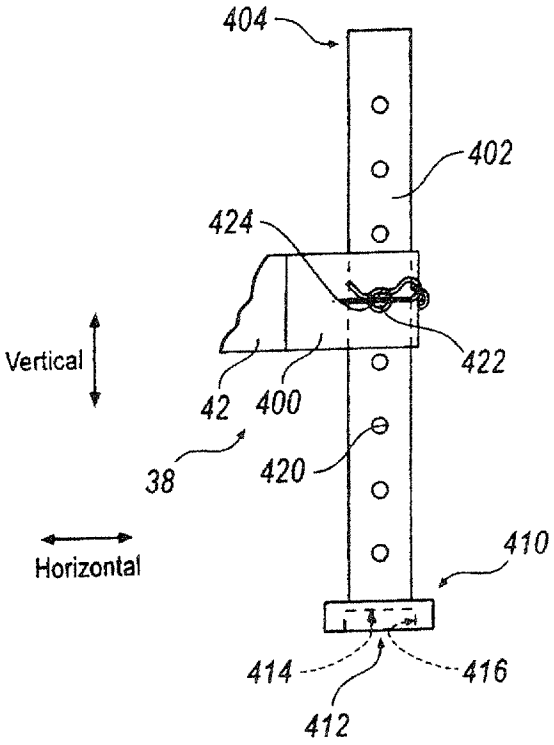
FIG. 10 is an enlarged view of portion 10 of FIG. 1.

As best seen in FIGS. 10 and 11, each standoff assembly 38 includes a frame end attachment 400, having a support member, or a supporting tube, 402 interposed therein. Each supporting tube 402 includes an upper end 404 and a lower base cap 410 attached to an opposing end. In the embodiment illustrated, the lower base cap 410 has an opening 412 defined by a horizontal abutting surface 414 and a contoured vertical surface 416 formed therein. The horizontal abutting surface 414 and the contoured vertical surface 416 are sized to matingly receive the upper end 404 of another standoff assembly 38, as best seen in FIG. 12. The supporting tubes 402 each include a plurality of adjustment apertures 420 formed generally horizontally. Each standoff assembly 38 also includes an adjustment pin 422. Each frame end attachment 400 includes a pair of pin apertures 430 formed therein.

As will be appreciated, the supporting tube 402 may be guided vertically within the frame end attachment 400 and releasably secured in position by inserting adjustment pin 422 through pin apertures 430 and one of the adjustment apertures 420. In this manner, the supporting tubes 402 of a building 20 may be adjusted (preferably to a lower adjustment location as illustrated in FIG. 12) for transportation of building 20. Furthermore, the supporting tubes 402 of a building 20 may be adjusted to other adjustment apertures 420 positions when erecting building 20 on a surface of constant or varying grade, or when positioning a building 20 at a desired height above grade.

Additionally, buildings 20 may be stacked when in the fully collapsed configuration, as best seen in FIG. 12. To securely stack buildings 20, the supporting tubes 402 are adjusted to a lower adjustment location and each lower base cap 410 of a building 20 is positioned over an upper end 404 of another building 20, as shown in the embodiment illustrated.

The preceding description has been presented only to illustrate and describe exemplary embodiments of the methods and systems of the present invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope. The scope of the invention is limited solely by the following claims.

What is claimed is:

1. A selectively collapsible structure comprising:

a base;

a first side wall rotatably attached to the base, and having angular movement relative to the base between collapsed and erected configurations;

a second side wall rotatably attached to the base, and having angular movement relative to the base between collapsed and erected configurations, the first and second side walls having angular movements independent of each other relative to the base;

a roof guidingly coupled to both the first side wall and the second side wall and having movement relative to the base guided by angular movement of the first and second side walls between their collapsed and erected configurations;

a biasing assembly urging the structure into a fully erected configuration, the biasing assembly having first and second states in which it has relatively greater and lesser amounts of stored energy, respectively, the first and second side walls urged from their collapsed configurations toward their erected configurations by transition of the biasing mechanism from its first state toward its second state; and a standoff assembly having at least two support members, each support member being defined by first and second ends and having a base cap attached to the second end, wherein the base cap further comprises an opening that is sized to matingly receive the first end of a separate support member of a second standoff assembly when the collapsible structure is in a storage configuration.

2. The structure of claim 1, wherein the standoff assembly further comprises a leveling mechanism that selectively provides a leveling adjustment for the structure in the fully erected configuration, and wherein the support members selectively mate with a portion of the second standoff assembly of a second structure to permit stacking and transport of the structure and the second structure when in a fully collapsed configuration.

3. The structure of claim 2, wherein the leveling mechanism further comprises a plurality of spaced apart holes that cooperates with a selectively removable adjustment pin.

4. The structure of claim 1, wherein the biasing assembly includes a cable and a spring.

5. The structure of claim 4, wherein the spring selectively provides a biasing torsion force.

6. The structure of claim 4, wherein the spring selectively provides a biasing axial force.

7. The structure of claim 1, further comprising a front wall rotatably attached to the base.

8. The structure of claim 1, further comprising a back wall rotatably attached to the base, wherein the first side wall and the second side wall are selectively positioned above the front wall and the back wall when the structure is collapsed.

9. The structure of claim 1, wherein the opening of the base cap is defined by a horizontal abutting surface and a contoured vertical surface formed therein.

10. A selectively collapsible structure comprising:

a base;

a first side wall rotatably attached to the bade, and having angular movement relative to the base between collapsed and erected configurations;

a second side wall rotatably attached to the base, and having angular movement relative to the base between collapsed and erected configurations, the first and second side walls having angular movements independent of each other relative to the base;

a roof guidingly coupled to both the first side wall and the second side wall and having movement relative to the base guided by angular movement of the first and second side walls between their collapsed and erected configurations; and a standoff assembly having a leveling adjustment mechanism for selectively providing a leveling adjustment for the structure in a fully erected configuration, and wherein each standoff assembly further includes at least two support members, each support member being defined by first and second ends and having a base cap attached to the second end that is configured for selectively mating with an upper end of a separate support member of a second standoff assembly of a second structure to permit stacking of the structure and the second structure when in a fully collapsed configuration, the base cap further comprising an opening that is sized to matingly receive the upper end of the separate support member of the second standoff assembly.

11. The structure of claim 10, further comprising a biasing assembly selectively urging the structure into the fully erected configuration.

12. The structure of claim 11, wherein the biasing assembly includes a cable and a spring.

13. The structure of claim 12, wherein the spring is preloaded to provide a desired amount of force to urge the roof away from the base at least partially when the structure is transformed from a fully collapsed configuration to a fully erected configuration.

14. The structure of claim 10, further comprising a front wall rotatably attached to the base.

15. The structure of claim 10, further comprising a back wall rotatably attached to the base, wherein the first side wall and the second side wall are selectively positioned above the front wall and the back wall when the structure is collapsed.

16. The structure of claim 10, further comprising a plurality of standoff assemblies adjustably coupled to the base.

17. The structure of claim 10, wherein the standoff assembly is at least vertically adjustable relative to the base.

18. The structure of claim 10, wherein the opening of the base cap is defined by a horizontal abutting surface and a contoured vertical surface formed therein.

19. The structure of claim 10, wherein the leveling adjustment mechanism further comprises a plurality of spaced apart holes that cooperates with a selectively removable adjustment pin.

20. A selectively collapsible structure having collapsed and erected configurations comprising:

a substantially horizontal base;

a floor panel positioned above the base;

a roof having a lowered position proximate to the base in the collapsed configuration and a raised position distant from the base in the erected configuration; and first and second substantially planar side walls interposed between and rotatably attached to one of the base and the roof, each side wall having first and second angular positions relative to said one of the base and the roof, the side walls superposing the base and the roof in the collapsed configuration and extending between the base and the roof in the erected configuration, the other of the base and the roof guidingly coupled to the first and second side walls, the roof moved between its lowered and raised positions in response to angular movement of the side walls between their first and second positions, the first and second side walls having angular movements independent of each other between their respective first and second angular positions;

wherein the first and second side walls are at all limes biased towards their second angular position, and movement of the roof toward its raised position is assisted by the side wall biases.

21. The structure of claim 20, wherein the first and second side walls are rotatably fixed to the base, and slidably engaged with the roof.

22. The structure of claim 20, further comprising substantially planar front and hack walls each rotatably attached to said base, the front and back walls each having collapsed and erected positions, the trout and hack walls superposing the base and the roof in their collapsed positions and extending between the base and the roof in their erected positions, the front and back walls each moveable between its respective collapsed and erected positions only when the roof is in its raised position.

23. The structure of claim 22, wherein the first and second side walls are superpositioned over the front and hack walls in the structure collapsed configuration.

* * * * *